US006132080A

United States Patent [19]

Gurth

[11] Patent Number: 6,132,080

[45] Date of Patent: Oct. 17, 2000

[54] ROTARY DISC MIXER APPARATUS

[76] Inventor: Max I. Gurth, 1781 Carob Tree La., El Cajon, Calif. 92021

[21] Appl. No.: 09/437,823

[22] Filed: Nov. 10, 1999

Related U.S. Application Data

[63] Continuation-in-part of application No. 09/022,161, Feb. 11, 1998, abandoned.

[51] Int. Cl.[7] ..... B01F 7/26

[52] U.S. Cl. ..... 366/286; 366/315; 366/317

[58] Field of Search ..... 366/242–252, 366/262, 263, 265, 285, 286, 331, 315–317, 326.1; 416/90 R, 92, 120, 198 R, 205, 231 A

[56] References Cited

U.S. PATENT DOCUMENTS

| | | | |
|---|---|---|---|
| 776,383 | 11/1904 | Bryan | 366/326.1 |
| 825,897 | 7/1906 | Fay | 366/326.1 |
| 1,765,386 | 6/1930 | Wait | 366/265 |
| 1,837,636 | 12/1931 | Voss | 366/326.1 |
| 2,230,146 | 1/1941 | Myers | 366/317 |
| 2,239,152 | 4/1941 | Jacobsen | 366/263 |
| 2,464,588 | 3/1949 | Knudsen et al. | 366/317 |
| 2,530,814 | 11/1950 | De Becze et al. | 366/263 |
| 2,626,135 | 1/1953 | Serner | 366/316 |
| 3,013,866 | 12/1961 | Samaniego et al. | 366/315 |
| 3,062,627 | 11/1962 | Zuiderweg | 366/316 |
| 3,147,957 | 9/1964 | Martin | 366/263 |
| 3,222,038 | 12/1965 | Ashcraft | 366/316 |
| 3,273,865 | 9/1966 | White | 366/316 |
| 3,326,532 | 6/1967 | Lodge | 366/286 |
| 3,464,636 | 9/1969 | Byers | 366/315 |
| 3,486,741 | 12/1969 | Midgette | 366/316 |
| 3,690,621 | 9/1972 | Tanaka | 366/265 |
| 4,483,624 | 11/1984 | Bacon, Jr. et al. | 366/263 |
| 4,893,941 | 1/1990 | Wayte | 366/265 |

FOREIGN PATENT DOCUMENTS

| | | | |
|---|---|---|---|
| 216294 | 7/1961 | Austria | 366/331 |
| 94/20201 | 7/1961 | WIPO | 366/331 |

*Primary Examiner*—Charles E. Cooley
*Attorney, Agent, or Firm*—Baker & Maxham

[57] ABSTRACT

A mixing apparatus for mixing delicate materials, has a rotor extending into a vessel for containing a quantity of material to be mixed, a support associated with the vessel, the mixing rotor mounted on the support for positioning in the vessel, the rotor comprising a rotatable shaft, a plurality of disc packs made up of a plurality of circular discs, each disc having an aperture in a center thereof, and means for mounting the discs on the shaft in axially spaced relation for enabling liquid to flow into the center of the discs and outward between the discs, and a motor drivingly connected to the rotor for rotating the rotor.

20 Claims, 6 Drawing Sheets

ROTARY DISC MIXER APPARATUS

REFERENCE TO RELATED APPLICATIONS

This is a continuation-in-part of application Ser. No. 09/022,161 filed Feb. 11, 1998, entitled "ROTARY DISC MIXER APPARATUS AND METHOD" now abandoned.

BACKGROUND OF THE INVENTION

The present invention relates to mixing apparatus and pertains particularly to an improved rotary disc mixer.

Many manufacturing and other processes require the mixing of various liquids and materials in liquids. The traditional mixer is a rotating paddle arrangement mounted on a shaft and rotating about a vertical axis in a large vessel. In this arrangement a vertically mounted rotating shaft carries a plurality of paddles extending radially outward on arms disposed about the axis of the shaft. The rotating shaft moves the paddles through the liquid as the shaft rotates lifting the fluid from the bottom of the tank or vessel and pushing it to the top of the vessel. It does not pull the materials from the corners and crevices of the vessel. This typically results in the liquid and materials not being thoroughly mixed. Also these mixers dot not move the liquid and materials along the walls of the vessel.

The paddle system is satisfactory for many applications. However, particularly in the food and pharmaceutical industries, there are many delicate and fragile shear and impact sensitive materials that can be easily damaged with this type mixer. For this reason these materials cannot be satisfactorily mixed with these mixers and in this manner. The moving paddles can impact and bruise or otherwise cause damage to delicate and fragile materials.

Another material which cannot be satisfactorily mixed with the typical paddle mixer is highly viscous materials and materials having fibers and the like therein. These materials can build up on the paddles and can inhibit or resist turbulent flow necessary for thorough mixing.

Another class of materials which are not suitable for mixing with paddle mixers is highly abrasive materials. Such materials wear away the paddles at a rapid rate resulting in costly down time and repairs.

Accordingly there is a need for an improved mixing apparatus for mixing of delicate shear and impact sensitive materials and abrasive materials.

It is therefore desirable to have an improved mixing apparatus for mixing of delicate and other difficult to mix materials.

SUMMARY OF THE INVENTION

It is therefore a primary object of the present invention to provide an improved mixing apparatus for mixing of delicate, sensitive and flow resistant materials.

In accordance with a primary object of the present invention, a rotary disc fluid mixing apparatus for mixing materials, comprises a support means, a mixing rotor mounted on said support means for positioning in said a fluid for mixing same, said rotor comprising a rotatable shaft, a plurality of circular discs, at least one having an aperture in a center thereof, and means for mounting said discs on an end of said shaft in axially spaced relation for enabling liquid to flow through said aperture and outward between said discs a motor drivingly connected to said shaft for rotating said rotor.

BRIEF DESCRIPTION OF THE DRAWINGS

The above and other objects and advantages of the present invention will become apparent from the following description when read in conjunction with the accompanying drawings wherein.

DETAILED DESCRIPTION OF THE PREFERRED EMBODIMENTS

Figure 1:
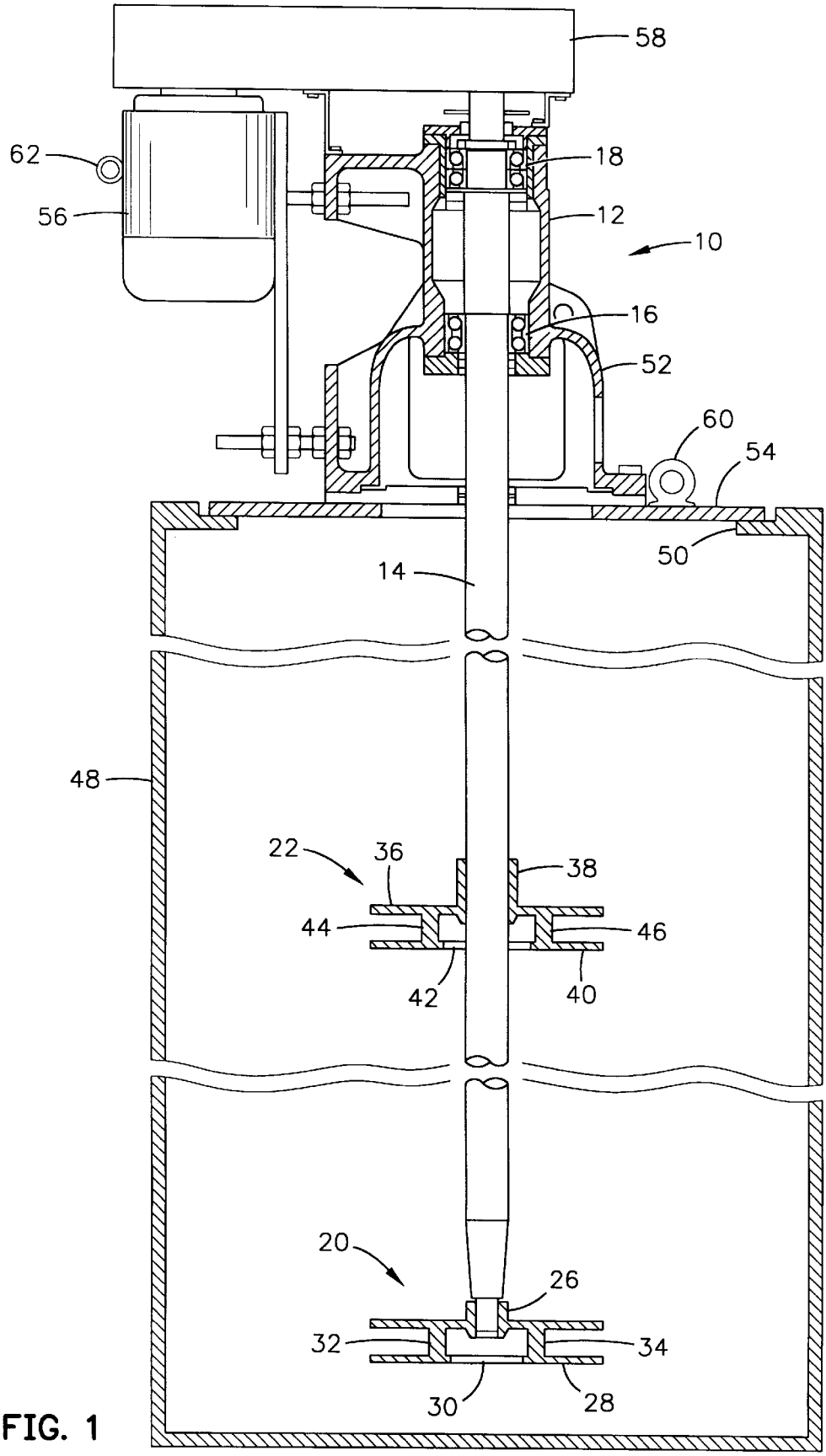
FIG. 1 is a side elevation view in section of an exemplary first embodiment of the present invention.

Referring to FIG. 1, an exemplary embodiment of the invention is illustrated and designated generally by the numeral 10. The apparatus, in accordance with the invention, comprises a rotary disc fluid mixer which comprises a main support housing 12 having an elongated rotary shaft 14 rotatably mounted therein in a pair of spaced bearing assemblies 16 and 18. A pair of disc packs 20 and 22 are mounted on the shaft and act as impellers for drawing fluid in and propelling it outward, thereby creating flowing of the fluid within the vessel. The shaft can have any number of disc packs along its length as will be apparent. Each disc pack comprises at least a pair of spaced apart rotary discs, one of which has a central generally unobstructed aperture therethrough for drawing fluid in and the other of which is devoid of an aperture and is connected directly to the shaft. The discs can be planar with planar relatively smooth surfaces or may have spiral vanes or ribs on the opposed planar surfaces as will be discussed.

The disc pack 20, for example, has a main disc 24 with a central hub 26 for mounting directly on the end of shaft 14. The disc, as illustrated, is generally circular and planar disc, having planar surfaces on both sides thereof and no aperture therein. A second disc 28 is spaced from the first disc 24 and has a central aperture 30 through which fluid flows into the space between the opposing faces of the two discs 24 and 28. The disc 28 is connected or secured to and supported by the disc 26 by means of pins 32 and 34. These may be separate pins or formed integral with the disc pack assembly and are preferably at the innermost diameter of the disc 34 to minimize impact on materials moving through the aperture and space between the discs. The discs of each disc pack are each preferably of substantially uniform thickness as shown in the Figures. The pins connect the discs of each disc pack in an axially spaced relation at a distance less than the radius of the central aperture as shown in FIG. 1. The opposing faces of the discs act on the fluid imposing a shear force or drag to propel it radially outward from between the discs.

A preferred way of forming a disc pack assembly, particularly for delicate and fragile solutions or mixtures, is to machine the entire assembly from a casting or from a blank or billet so that the entire unit is a unitary integral unit. This eliminates cracks and joints in the assembly and the problems of interference with flow of particles and the like caused by the sharp edges of bolts, screws and the like. In an alternate form of the disc pack outwardly spiraling ridges may be formed on the opposing faces of the disc to increase the propelling effect of the disc. The ridge can be almost any height but in most cases is preferably on the order of about twice the thickness of the disc.

The discs normally propel the fluid by surface friction of the planar faces thereby applying a centrifugal force to the fluid forcing it outward from the space between the discs. This has an effect of propelling the fluid radially outward from between the disc creating a central void which draws fluid from the vessel into the space between the discs, and continuing to propel the fluid outward.

In the FIG. 1 illustrated embodiment a second disc pack designated generally at 22 is adjustably mounted on shaft 14 in a manner so that it may be positioned at selected positions along the length of the shaft. This disc pack is similar to the disc pack 20 and comprises a disc 36 having a central hub 38 for connecting to the shaft 14. A second disc 40 includes a central aperture 42 that is larger than the shaft 14 and is connected by pins 44 and 46 to the disc 36. Any number of these disc packs may be selectively positioned in any desired array along the length of the shaft 14. The disc packs may also be formed to have multiple apertured discs with a single centrally positioned non-apertured disc. The apertured discs may be disposed on one side of the non-apertured disc or they may be on both sides thereof to draw fluid from both directions along the axis of the vessel. The rotor may also be made up of a continuous series of closely spaced disc pack units positioned along the length thereof. It may also be made up of one large disc pack unit of one drive disc and a plurality of the apertured discs.

The illustrated mixing apparatus is designed to cooperate with any form of vessel, such as an open top container or tank 48 having an opening 50 through which the shaft extends and through which material may be introduced and removed from the tank. The mixing apparatus, as illustrated, has an extension 52 of the housing which is secured, such as by bolts or the like, to a cover or support plate 54 for the container 48. A drive motor 56 is mounted on the housing 12 and is drivingly connected such as by V-belts or the like (not shown), but covered by protective cover 58. Any form of drive motor may be used such as, but not limited to, internal combustion engines, turbines, air and hydraulic motors.

The unit may be provided with cable connecting brackets 60 and 62 for supporting the mixer apparatus from suitable support structure for lifting the mixing apparatus from and inserting it into a mixing tank. The mixer is shown co-axial with the substantially cylindrical tank but may be at any angle to the axis, including at right angles thereto. Also, the tank may have any number of different configurations, such as square, spherical or any other suitable configuration. The mixing apparatus can be used in combination with vessels and containers of any shape and size and may be positioned at any position or angle in the vessel. It may also be moved about in the vessel periodically or continuously. One preferred arrangement is that it be position substantially co-axially of a cylindrical vessel.

Figure 2:
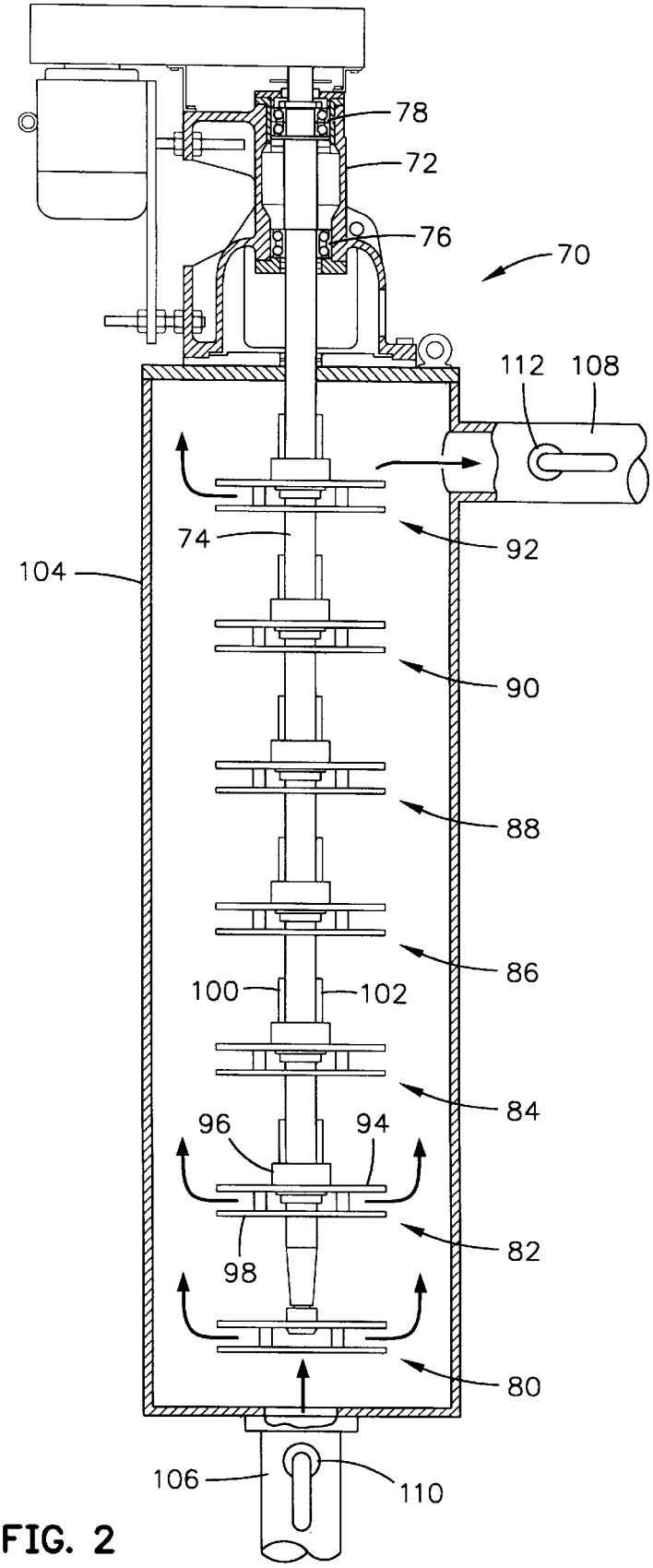
FIG. 2 is a view like FIG. 1 of an alternate embodiment of the present invention.

Referring to FIG. 2, an alternate exemplary embodiment of the invention is illustrated and designated generally by the numeral 70. The apparatus, as in the prior embodiment, comprises a rotary disc fluid mixer having a main support housing 72 having an elongated rotary shaft 74 mounted therein in a pair of spaced bearing assemblies 76 and 78. A plurality of disc packs 80, 82, 84, 86, 88, 90 and 92 are mounted on the shaft and act as impellers for drawing fluid in at their centers and propelling it radially outward, thereby creating currents or flow of the fluid throughout the volume within the vessel.

Each disc pack comprises at least a pair of spaced apart rotary discs, at least one of which has a central opening serving as an inlet for drawing fluid in between the discs. The disc pack 80 may be substantially the same as that of the prior embodiment and has a main disc with a central hub for mounting directly on the end of shaft 74. The illustrated main or mounting disc is generally circular and planar, having planar surfaces on both sides thereof. A second disc is spaced from the first disc and has a central aperture functioning as an inlet through which fluid flows into the space between the two discs. A suitable drive motor is mounted on the housing 72 and is drivingly connected such as by V-belts or the like (not shown) to drive the mixing rotor, as in the prior embodiment.

The discs normally propel the fluid by surface friction or shear force thereby applying a centrifugal force to the fluid forcing it outward from the space between the discs. This has an effect of propelling the fluid radially outward from between the disc creating a void which draws fluid from the vessel into the space between the discs, and continuing to propel the fluid outward.

In this embodiment the remaining disc packs are adjustably mounted on shaft 74 so that they may be adjustably positioned at selected positions along the length of the shaft. These disc packs are similar to the disc pack 22 and comprises a disc 94 having a central hub 96 for drivingly connecting to the shaft 74. A second disc 98 includes a central aperture and is connected by pins to the disc 94. A pair of elongated keys 100 and 102 rest in keyways or slots in shaft 74 and engage keyways in the hub 96 in the usual manner. Any number of these disc packs may be positioned along the length of the shaft 74 and in any selected spatial relationship. The disc packs may also be formed to have multiple apertured discs with or without a single centrally positioned non-apertured disc. The rotor may also be made up of a continuous series of closely spaced disc units positioned along the length thereof.

The illustrated mixing apparatus is designed to cooperate with a vessel, such as an elongated container or tank 104 having an inlet opening 106 such as axially at one end and an outlet 108 opening such as at the opposite end in a side. This effectively provides a continuous flow mixing or pumping unit. The inlet is provided with a valve 110 operable in the usual manner in order to selectively control the flow of fluid into the vessel. The outlet is also provided with a valve 112 operable in the usual manner in order to selectively control the flow of fluid out of the mixing apparatus. Thus, the mixing apparatus may be used in either a continuous flow mode or a batch mode.

The mixer may be used with low or high viscous fluids. When the fluid is highly viscous, the discs should be closer to the diameter of the vessel so that the edges of the discs extend close to the walls of the vessel as shown in FIG. 2. This enables the rotor to push the fluid out to the walls and pull the fluid in from the walls of the vessel. In one preferred embodiment, the discs may be spaced from the wall a distance of about equal to or about twice the distance between the discs.

Figure 3:
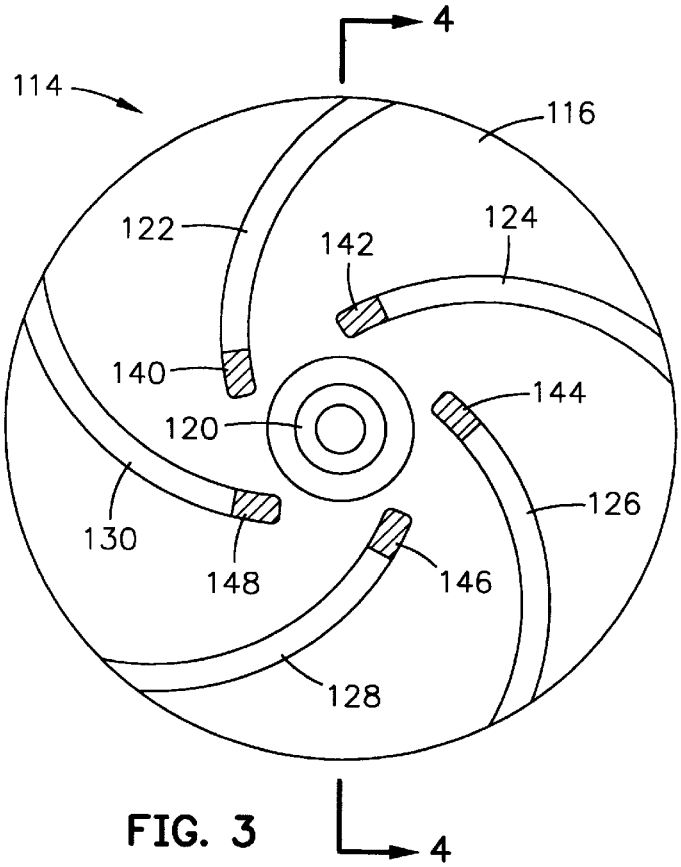
FIG. 3 is a plan view in section of one disc of an alternate embodiment of the disc pack.
Figure 4:
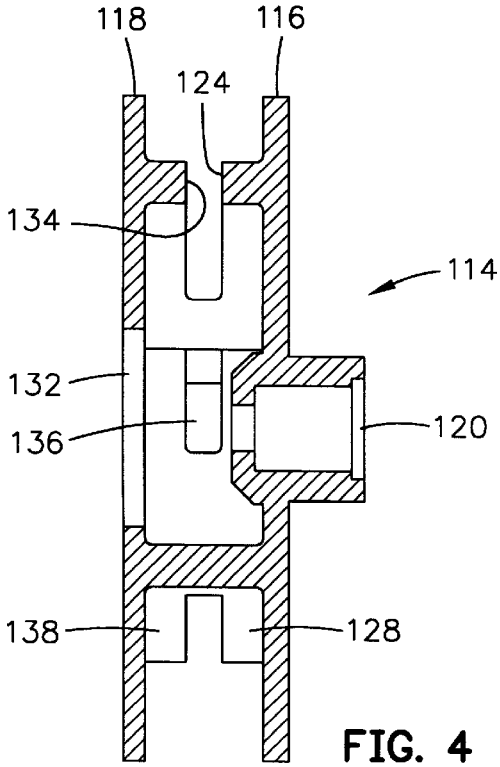
FIG. 4 is a plan a front elevation view in section of the disc pack of FIG. 3.

Referring to FIGS. 3 and 4, an alternate construction of a disc pack is illustrated and designated generally by the numeral 114. The disc pack comprises a pair of spaced apart rotary discs 116 and 118 which are cast together and finished by machining. The discs are each formed with a plurality of radially extending curved vanes or ribs on the opposed faces which add to the frictional force of the disc faces. The disc 116 is formed with a shaft mounting hub 120 and with ribs 122, 124, 126, 128 and 130. The disc 118 has a central opening 132 for drawing fluid in between the discs and includes ribs, only three of which 134, 136 and 138 are shown. The ribs may have any height but, in one preferred embodiment, has a height of between the thickness of the disc to about twice the thickness of the disc. The two discs 116 and 118 of the disc pack are connected together at the inner ends of the ribs pins at 140, 142, 144, 146 and 148. The pins, as illustrated in FIG. 3, are rounded to eliminate sharp corners and to provide for a smoother flow of fluid and mixture. A mixing rotor with these discs will have the ability to apply a higher force to the fluids in a mixing vessel than with planar surfaces. Similarly, closely spaces pairs of discs have the ability to apply more force to fluid between the discs than farther spaced or individual discs.

Figure 5:
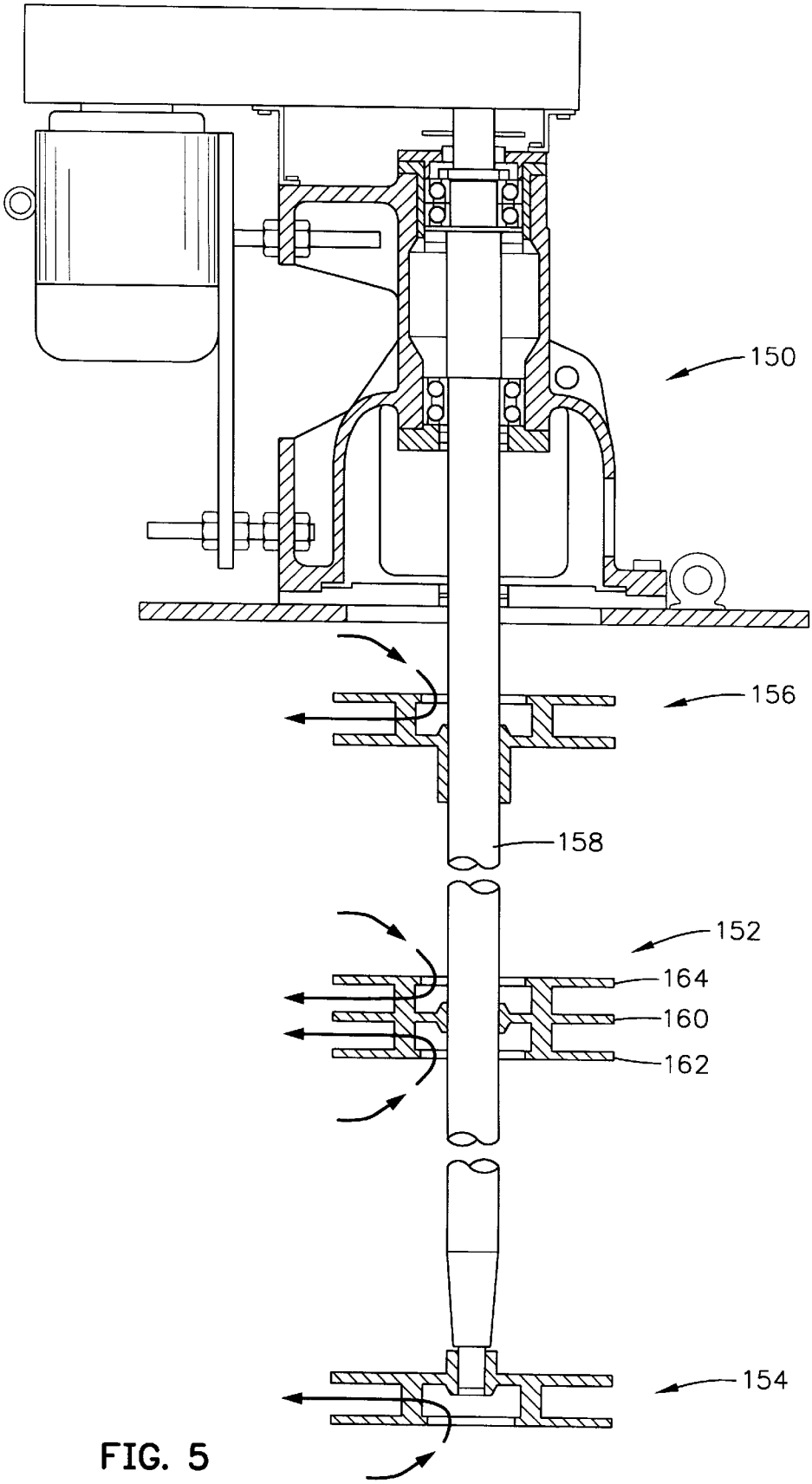
FIG. 5 is a view like FIG. 1 of a further embodiment of the present invention.

The disc packs may also be oriented or configured so that the rotor pulls fluid in opposite axial directions along and from both ends of the rotor or the vessel toward the center. As shown in FIG. 5, a mixer 150 is formed of a central rotor having a central disc pack 152 and end packs 154 and 156 mounted on an elongated shaft 158. The rotor is configured to have a central disc pack 152 having a single central mounting disc 160 with an apertured disc 162 on one side and an apertured disk 164 on the other side. The disk pack 154 on the distal or outer end of the shaft is like the end pack in prior embodiments. The disc pack 156 is on the near or proximal end of the shaft and is like prior described disc packs but oriented in the opposite direction along the axis of the shaft 158. The two end disk packs pull fluid from the opposite ends of the rotor or vessel and forces it radially outward as shown by the arrows. The central disk pack draws fluid from both directions along the shaft and forces it outward as shown by the arrows.

Figure 6:
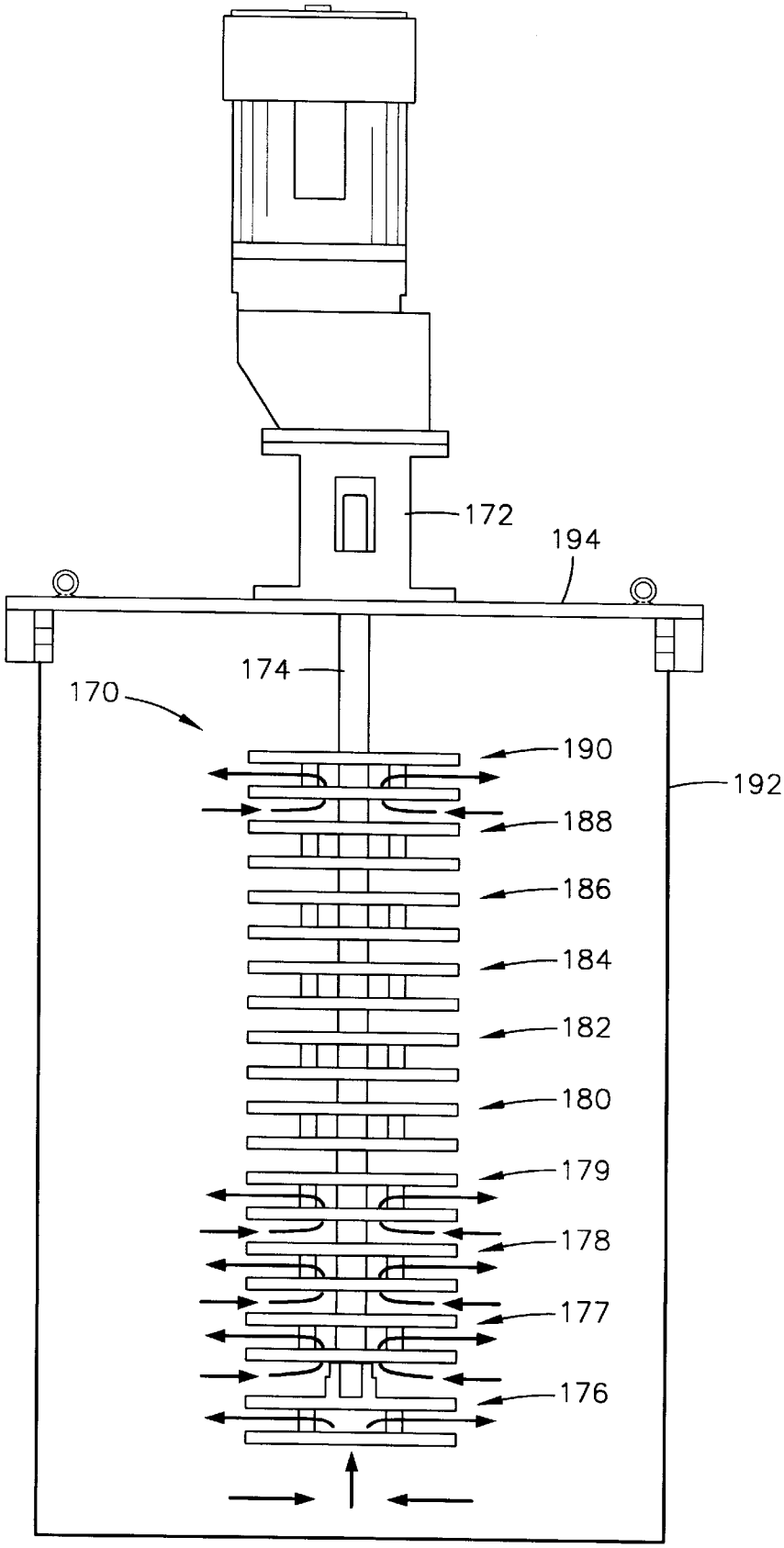
FIG. 6 is a view like FIG. 1 of another embodiment of the present invention.

Referring to FIG. 6, another alternate exemplary embodiment of the invention is illustrated wherein a mixing rotor designated generally by the numeral 170 is positioned centrally in a vessel. The apparatus, as in the prior embodiment, comprises a rotary disc fluid mixer having a main support housing 172 having an elongated rotary shaft 174 mounted therein in a pair of spaced bearing assemblies. A plurality of disc packs 176, 177, 178, 179, 180, 182, 184, 186, 188 and 190 are mounted on the shaft similar to those in FIG. 2, but in a more compact closely spaced array. These disc packs act as impellers for drawing fluid in at their centers and propelling it radially outward, thereby creating currents or flow of the fluid throughout the entire volume within the vessel.

Each disc pack comprises at least a pair of spaced apart rotary discs, at least one of which has a central hub (mounting disc) for mounting on the shaft and the other has a central aperture or opening (apertured disc) serving as an inlet for drawing fluid into the space between the discs. The apertured disc is connected to the mounting disc by pins closely adjacent to the central opening. The disc pack 176 may be substantially the same as the end unit of any of the prior embodiments and has a main disc with a central hub for mounting directly on the end of shaft 174. The remaining disc packs are like those mounted along the shaft in prior embodiments. The illustrated main or mounting disc is generally circular and planar, having planar surfaces on both sides thereof and a central mounting hub. As shown by the series of arrows, the fluid flows upward into the center of the apertured disc of the bottom disc pack 176 and out between the discs of that pack. In the second and subsequent disc pack fluid flows into the space between the two disc packs and out through the space between the discs of each disc pack.

Figure 7:
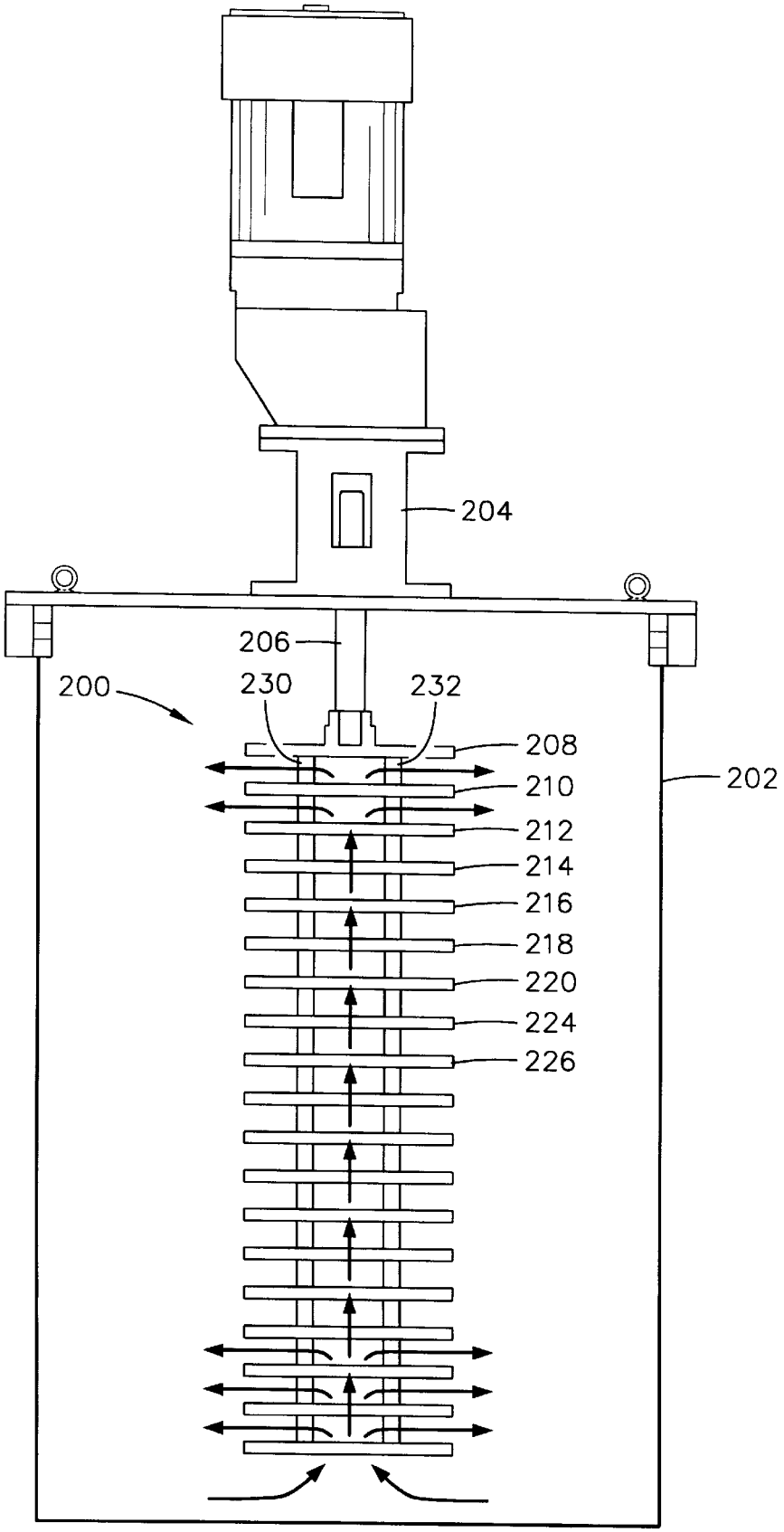
FIG. 7 is a view like FIG. 1 of a still further embodiment of the present invention.

Referring to FIG. 7, a further alternate exemplary embodiment of the invention is illustrated wherein a mixing rotor designated generally by the numeral 200 is positioned centrally in a vessel 202. The apparatus, as in the prior embodiment, comprises a rotary disc fluid mixer having a main support housing 204 having an elongated rotary shaft 206 mounted therein in a pair of spaced bearing assemblies. A disc pack with plurality of discs comprises a primary mounting disc 208 mounted on the end of shaft 206 with a plurality of apertured discs 210, 212, 214, 216 , 218, 220, 224 etc., connected together and to mounting disc 208 by a plurality of pins 230 and 232 at the inner diameter of the apertured discs This disc pack act as an impeller for drawing fluid in at the disc centers and propelling it radially outward, thereby creating currents or flow of the fluid throughout the entire volume within the vessel. The fluid flows the length of the rotor through the center aperture of the discs and radially out from between the discs along the length of the impeller. The impellers of the present invention have a number of advantages over conventional mixers including the fact that they pull the fluid and mixture from all corners and crevices of the vessel. They also scrub the entire walls of the vessels.

While I have illustrated and described my invention by means of specific embodiments, it is to be understood that numerous changes and modifications may be made therein without departing from the spirit and scope of the invention, as defined in the appended claims.

I claim:

1. A rotary disc fluid mixing apparatus for mixing fluid materials in a container, comprising:

support member adapted for association with said container;

a mixing rotor mounted on said support member for positioning in said container, said rotor comprising an elongated shaft mounted for rotation on said support member and at least a first disc pack of a plurality of circular discs mounted on said shaft for rotation therewith, the at least first disc pack consisting essentially of a first disc having a central hub for mounting said disc pack on said shaft, a second disc having an unobstructed aperture in a center thereof, and a plurality of pins connecting said second disc to said first disc, the discs each having a substantially uniform thickness, the pins disposed at an innermost diameter defined by said aperture, the pins connecting said first and second discs in axially spaced relation at a distance less than the radius of said aperture for enabling a liquid to flow through said aperture and outward between said discs, the discs having opposed planar surfaces operative to propel the liquid by surface friction outward from the space between the discs.

2. A rotary disc fluid mixing apparatus according to claim 1, wherein said rotor comprises at least a second disc pack of a plurality of circular discs mounted on said shaft for rotation therewith, the at least second disc pack consisting essentially of a first disc having a central hub for mounting said disc pack on said shaft, a second disc having an unobstructed aperture in a center thereof, and a plurality of pins connecting said second disc to said first disc, the pins disposed at an innermost diameter defined by said aperture.

3. A rotary disc fluid mixing apparatus according to claim 1, wherein said opposed planar surfaces of said discs having substantially radially extending ribs having a height of no more than twice the thickness of the respective disc.

4. A rotary disc fluid mixing apparatus according to claim 1, wherein said disc pack is of a unitary construction cast as a unit and formed by machining.

5. A rotary disc fluid mixing apparatus according to claim 4, wherein said opposed surfaces of said discs having radially spirling ribs having a height of no more than twice the thickness of the respective disc.

6. A rotary disc fluid mixing apparatus according to claim 1, wherein said mixing rotor comprises at least a second disc pack, the second disc pack consisting essentially of: a first disc having a central hub mounting said disc pack on said shaft, a second disc having an unobstructed aperture in a center thereof, a plurality of pins connecting said second disc to one side of said first disc at an innermost diameter defined by said aperture, a third disc having an unobstructed aperture in a center thereof, a plurality of pins connecting said third disc to another side of said first disc at an innermost diameter defined by said aperture, the pins connecting said discs in axially spaced relation at a distance less than the radius of any one of said discs for enabling liquid to flow through said aperture and outward between said discs.

7. An apparatus according to claim 1 wherein said rotor is adapted to be mounted in the container and wherein said container has an inlet and an outlet and said rotor is effective to draw fluid in via said inlet and propel said fluid out via said outlet.

8. An apparatus according to claim 7 wherein said rotor includes a plurality of said disc packs, and said disc packs are selectively positionable along said shaft.

9. A rotary disc fluid mixing apparatus for mixing fluid materials in a container, comprising:

support means adapted for association with said container;

a mixing rotor mounted on said support means for positioning in said container, said rotor comprising an elongated shaft mounted for rotation on said support means and having a proximal end and a distal end, at least a first disc pack mounted on said shaft, the first disc pack consisting essentially of a first disc having a central hub for mounting said discs on said shaft, and a second disc having an unobstructed aperture in a center thereof, the discs each having a substantially uniform thickness, a plurality of pins connecting said first and second discs together, the pins disposed at an innermost diameter defined by said aperture, the pins connecting said first and second discs in axially spaced relation at a distance of less than the radius of said aperture for enabling liquid to flow through said aperture and outward between said discs, the discs having opposed substantially planar surfaces configured to propel a fluid by surface friction outward from the space between the discs; and a motor drivingly connected to said shaft for rotating said rotor.

10. A rotary disc fluid mixing apparatus according to claim 9, wherein said disc pack is of a unitary construction cast as a unit and formed by machining.

11. A rotary disc fluid mixing apparatus according to claim 9, wherein said opposed planar surfaces of said discs having radially spirling ribs having a height of no more than twice the thickness of the respective disc.

12. A rotary disc fluid mixing apparatus according to claim 9, wherein said mixing rotor comprises at least a second disc pack, the second disc pack consisting essentially of: a first disc having a central hub mounting said disc pack on said shaft, a second disc having an unobstructed aperture in a center thereof, a plurality of pins connecting said second disc to one side of said first disc at an innermost diameter defined by said aperture, a third disc having an unobstructed aperture in a center thereof, a plurality of pins connecting said third disc to another side of said first disc at an innermost diameter defined by said aperture, the pins connecting said discs in axially spaced relation at a distance less than the radius of any one of said discs for enabling liquid to flow through said aperture and outward between said discs.

13. An apparatus according to claim 12 wherein said said rotor is adapted to be mounted in the container which has an inlet and an outlet and said rotor is effective to draw fluid in via said inlet and propel said fluid out via said outlet.

14. An apparatus according to claim 13 wherein said rotor includes a plurality of said disc packs, and said disc packs are selectively positionable along said shaft.

15. A rotary disc fluid mixing apparatus for mixing fluid materials in a container, comprising:

an elongated cylindrical container for containing a quantity of a fluid material to be mixed, said vessel having a fluid inlet and a fluid outlet;

a support member adapted for mounting on one end of said container;

a mixing rotor mounted on said support member for positioning in said container, said rotor comprising an elongated shaft mounted for rotation on said support member and having a proximal end and a distal end, at least a first disc pack consisting essentially of a plurality of circular discs mounted on said shaft, the first disc pack consisting essentially of a first disc having a central hub for mounting said discs on said shaft, and a second disc having an unobstructed aperture in a center thereof, a plurality of pins connecting said first and second discs together, the pins disposed at an innermost diameter defined by said aperture, the pins connecting said first and second discs in axially spaced relation at a distance of less than the radius of the disc for enabling liquid to flow through said aperture and outward between said discs, the discs having opposed planar surfaces configured to propel a fluid by surface friction outward from the space between the discs;

at least a second disc pack, the second disc pack consisting essentially of a first disc having a central hub mounting said disc pack on said shaft, a second disc having an unobstructed aperture in a center thereof, a plurality of pins connecting said second disc to one side of said first disc at an innermost diameter defined by said aperture, a third disc having an unobstructed aperture in a center thereof, a plurality of pins connecting said third disc to another side of said first disc at an innermost diameter defined by said aperture, the pins connecting said discs in axially spaced relation at a distance less than the radius of any one of said discs for enabling liquid to flow through said aperture and outward between said discs; and a motor drivingly connected to said shaft for rotating said rotor.

16. A rotary disc fluid mixing apparatus according to claim 15, wherein said first and said second disc pack are each of a unitary construction cast as a unit and formed by machining.

17. A rotary disc fluid mixing apparatus according to claim 16, wherein said opposed planar surfaces of said discs having radially spirling ribs having a height of no more than twice the thickness of the respective disc.

18. An apparatus according to claim 15 wherein said container is a vessel which has an inlet and an outlet and said rotor is effective to draw fluid in via said inlet and propel said fluid out via said outlet.

19. An apparatus according to claim 18 wherein said rotor includes a plurality of said disc packs selectively positionable along said shaft.

20. An apparatus according to claim 15 wherein said rotor includes at least a third disc pack, the third disc pack consisting essentially of a first disc having a central hub for mounting said discs on said shaft, and a second disc having an unobstructed aperture in a center thereof, a plurality of pins connecting said first and second discs together, the pins disposed at an innermost diameter defined by said aperture, the pins connecting said first and second discs in axially spaced relation at a distance of less than the radius of the disc for enabling liquid to flow through said aperture and outward between said discs, said first disc pack and said third disc pack oriented to pull fluid from opposite axial directions.

* * * * *